United States Patent [19]

Steinwender

[11] Patent Number: 5,069,015

[45] Date of Patent: Dec. 3, 1991

[54] KEYSTONE SET

[75] Inventor: Reinhold Steinwender, Bad Kleinkirchheim, Fed. Rep. of Germany

[73] Assignee: Radex-Heraklith Industriebeteiligungs Aktiengesellschaft, Vienna, Austria

[21] Appl. No.: 594,110

[22] Filed: Oct. 9, 1990

[30] Foreign Application Priority Data

Oct. 10, 1989 [DE] Fed. Rep. of Germany ..... 3933744

[51] Int. Cl.[5] ..... E04C 3/38; E04B 1/32; F27D 1/02; F23M 5/06

[52] U.S. Cl. ..... 52/575; 52/245; 52/608; 52/89; 110/335; 110/337

[58] Field of Search ..... 52/593–595, 52/85, 86, 89, 575, 245, 608; 110/335, 336, 337, 331, 338

[56] References Cited

U.S. PATENT DOCUMENTS

| | | | |
|---|---|---|---|
| 307,155 | 10/1884 | Williams | 52/89 |
| 693,826 | 2/1902 | Bottger | 52/89 |
| 1,230,441 | 6/1917 | Stevens | 110/335 |
| 1,242,669 | 10/1917 | Erken | 52/575 |
| 1,648,363 | 11/1927 | Reintjes | 110/335 |
| 2,561,933 | 7/1951 | Longenecker | 52/593 |

FOREIGN PATENT DOCUMENTS

| | | | |
|---|---|---|---|
| 19052 | of 1901 | United Kingdom | 52/89 |

*Primary Examiner*—John E. Murtagh
*Attorney, Agent, or Firm*—John F. A. Earley; John F. A. Earley, III

[57] ABSTRACT

The invention relates to a keystone set for installation in the transition region between two sections of an arch-shaped support structure, the set consisting of two transition stones, between which at least one keystone is axially insertable.

13 Claims, 2 Drawing Sheets

KEYSTONE SET

DESCRIPTION

Figure 1:
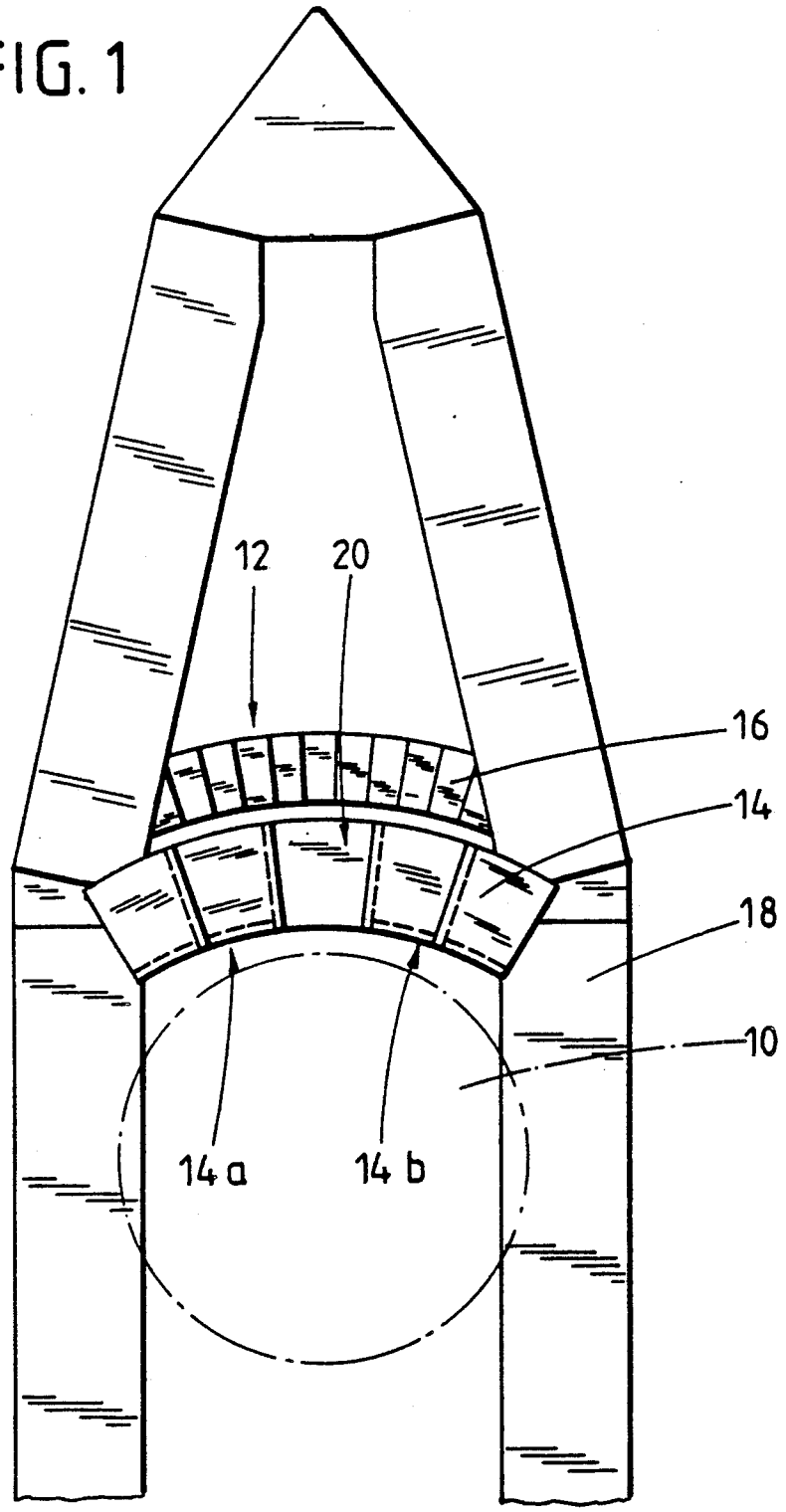

The invention relates to a keystone set for installation in the transition region between two sections of a support structure which is formed as an arch and consists of fire-resistant stones. Such arch constructions are used particularly in industrial furnaces, the prior art and the invention being described in more detail below with the example of an arch in the burner region of a shaft lime kiln, without thereby limiting the inventive notion.

An arch-like support structure of the type mentioned above is found in the region of the distributor bridge above the burner or burners. It generally consists of a plurality of arch-shaped rows of stones arranged one above another. According to the prior art, to make the arch shape, the individual stones are formed conically in the radial direction. A substantial disadvantage of this known construction is that the stones slip when the furnace is out of use, thus threatening the stability of the support structure. In order to minimized this disadvantage, it was proposed to make the stones profiled in the region of their contact faces, in particular with prismatic projections and recesses. Although slipping of individual stones is slightly reduces thereby, the disadvantage of this solution is the different compression of the stones under pressure, with the risk of crack formation during operation. Further, the individual stones can be slightly moved by strong lateral pressure of the body of lime in the kiln, and this could lead to a change in the statics of the arch.

The object of the invention is therefore to indicate a way of improving the statics of arch-like support structures composed of fire-resistant stones.

In this case, the invention is based on the notion that the above-mentioned disadvantages of known stone formats can be overcome by forming the individual stones with substantially radial tongue-and-groove devices, so that they can be inserted into one another radially and thus mutually position and stabilise one another within the arch-like support structure. At the same time, the stability is significantly improvided against lateral pressure from the lime body due to the tongue-and-groove formation.

Since, however, as mentioned above, a plurality of such arch-like support structures composed of fire-resistant stones must be arranged one above the other, it must also be considered how individual parts of the stonework can be mended in the case of repairs. Radial removal towards the outside is impossible at least in the region of the lower arch-like support structure, due to the row of stones lying above it. This gives rise to a further notion of the invention, in particular to form the arch-like support structure from two sections, which are formed so as to rum in opposite directions from one another, a keystone set then being inserted into the transition region between the two sections and having at least one keystone whose form is such that it is insertable axially with positive locking into the space between the previously inserted stones. For repairs, this keystone (the corresponding keystones) can be removed axially, so that the support structure is opened in order to permit the removal and replacement of further stones in the case of a repair.

The keystone according to the invention consists in its most general embodiment of two transition stones which, on their outer side, adjacent the respective last stone of the corresponding section of the support structure, have a corresponding tongue or groove profile to provide positive locking, and on their opposite faces are formed with a substantially axial step, the arrangement further consisting of at least one keystone whose shape is such that it is axially insertable with positive locking into the space between the transition stones.

In principle, the idea of the keystone set also consists in no longer joining the stones in the transition region between the sections of the arch-like support structure via radial tongue-and-groove joints, but in positioning them against one another by axial joining elements.

Generally, it is advantageous in this case to form the two sections of the arch-like support structure in opposite direction, since in this case the transition stones of the keystone set can have the same shape. This reduces stockkeeping of corresponding stones. Since the stones of the support structure and the transition stones have a specified size, this means that in the individual case the distance between respective transition stones will be different. Therefore, the invention proposes in an advantageous embodiment to form the keystone in two parts, in particular, for reasons of statics, in two structurally identical sections if possible, which lie opposite one another in a symmetrical manner. In this case, the contact faces of the keystones can be formed flat, in particular if they are formed conially from the outside inwards in the radial direction.

In the individual case, the keystones can then be cut or ground to the desired, so that in each case the gap between the transition stones is completely filled in order to stabilise the support structure as a whole.

However, it is equally possible to form the two keystones with a corresponding (axial) tongue-and-groove joint if this is desired.

In erecting the arch-shaped support structure, the first step is to arrange the two sections in opposite directions, starting from lateral support elements in the region of the distributor bridge, until these sections have a distance from one another sufficient to receive the keystone set. The transition stones are then mounted on the two end faces of the sections and have on the outside (facing the last stones of the sections) a corresponding radial tongue-and-groove profile, but on the inside (i.e. on the opposite faces) have a substantially axial step, so that the keystone or keystones can then be inserted into the space between the transition stones and fixed there.

Even if a second arch-like row of stones is then mounted above this, repairs can easily be carried out without having to replace the whole support structure. In this case, first only the keystones need to be removed axially, in order then to permit the removal of the transition stones or the stones of the sections of the support structure in the direction of the space which has been opened up and to permit replacement of damaged stones for new ones.

In other words, the arch can be closed and opened from the front without the need to give up the advantage of double-sided tongue-and-groove formation between the individual stones of the support structure. Due to the radial tongue-and-groove formation between the stones of the sections of the support structure and in the joining region of the transition stones, a significant improvement is achieved against sagging or slipping of individual stones of the arch, in particular if contraction should take place when the kiln is inactive.

The construction according to the invention is also superior to known arrangements in terms of its statics, but yet permits repairs to be made without having to dismantle the whole arch. This is particularly significant because damage generally occurs in the region of the lower arch (adjacent the burner).

If the sections of the arch are formed so as to run in opposite directions, this has the advantage, as mentioned above, that the arch is arranged virtually symmetrically from two sides and consequently the transition stones can be structurally identical. It would also be possible, however, to build the sections in the same direction and then to use different transition stones, in particular one stone with a groove and one stone with a tongue to join to the corresponding end stones of the sections. In this embodiment also, no changes are made as regards the formation of the keystones or keystone. The transition stones should preferably also be conically formed (viewed radially from the outside inwards), in order to make possible an even curve of the arch.

According to the field of application, the stones are manufactured from suitably fire-resistant qualities. For use in shaft lime kilns, the following qualities are particularly suitable:

Magnesia,
MA-spinel stones
Picrochromite stones,
Stones with a high alum earth content
Dolomite stones
Chamotte stones.

Further features of the invention will appear from the features of the remaing subclaims and from the rest of the application documents.

Figure 2:
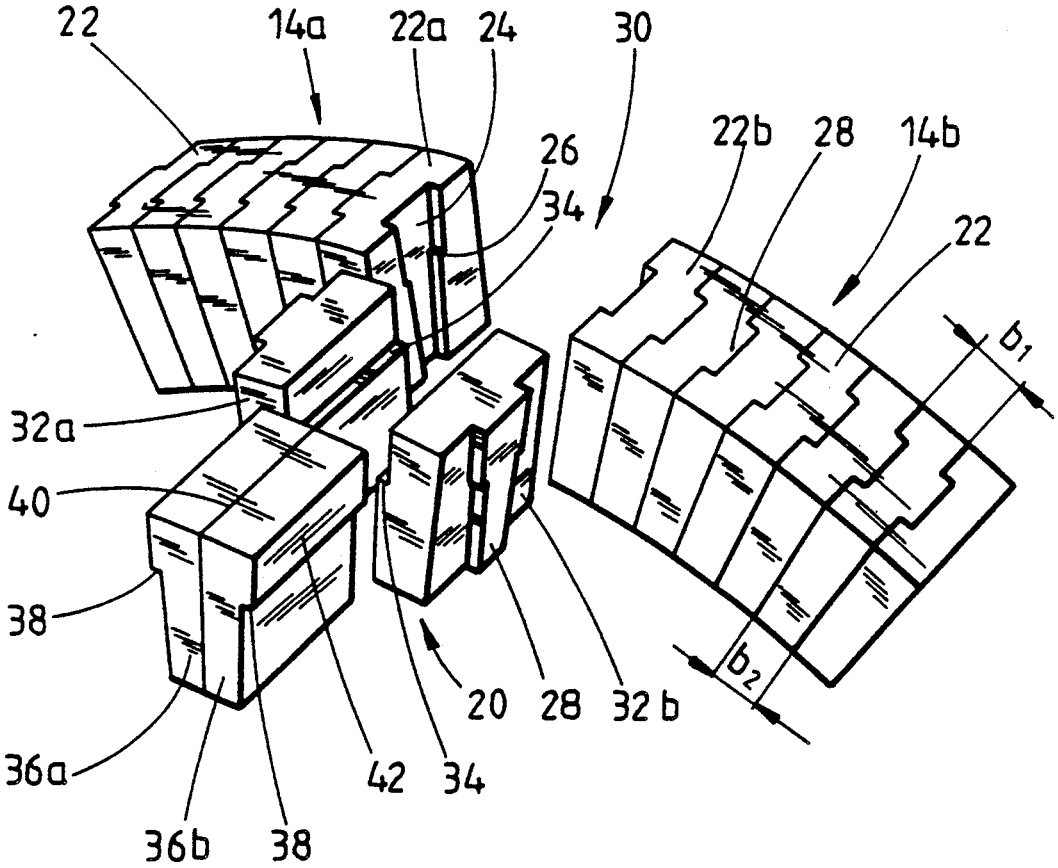

The invention is explained below with the aid of an embodiment, showing in diagrammatic form:

FIG. 1: a longitudinal section through the region of the distributors bridges of a lime annular shaft kiln, FIG. 2: a perspective partial view of the arch-like support structure according to the invention with a keystone set provided for the installation.

FIG. 1 shows the dome-like region above the distributor bridge of an annular shaft kiln for burning lime with a burner 10 and an arch-like support structure 12 mouned thereabove consisting of a first row of stones 14 and a second row of stones 16. The first row of stones 14 bears laterally on a support base 18 of the distributor bridge and is also arch-shaped like the second row of stones 16, as is shown.

The first row of stones 14 consists of two sections **14*a*, 14*b*, which, starting at their bearing region in the region of the support base 18, end at a distance from one another and are filled in the middle by a keystone set 20**. The detailed construction can be seen from FIG. 2.

Each of the stones 22 of the sections **14*a*, 14*b* is formed so as to taper conically in the radial direction (from top to bottom), i.e. the width B1 on the outer end is greater than the width B2 at the lower end. The stones 22 have on their corresponding face sections corresponding tongue-and-groove devices, and the shape of the corresponding grooves 24 can be clearly seen from the right-hand stone of the section 14*a*. First of all, it can be seen from this that the curve of the groove 24 is substantially radial. Further, the figure shows that the groove tapers conically from the outside inwards and has a step 26 along it. It is obvious that the corresponding tongues 28 are formed correspondingly, i.e. also taper conically from the outside inwards and have a step, in order to be insertable with positive locking in the corresponding groove 24**.

Finally, from FIG. 2 it can be seen that the sections **14*a*, 14*b* are arranged in opposite directions so that the two end stones 22*a*, 22*b*, which are spaced apart, each have the described groove 24** on their opposite faces.

The transition region 30 between the sections **14*a*, 14*b* is to be filled in this case with a keystone set 20, which consists of four elements in all. This includes two structurally identical transition stones 32*a*, 32*b*, which are arranged symmetrically to one another. To this end, the transition stone 32*a* has on its outer face a tongue 28, which corresponds to the tongues 28 of the stones 22, and is inserted radially from above with this tongue 28 into the groove 24 of the end stone 22*a*, until the step of the tongue 28 meets the step 26 of the groove 24. In the same manner, the transition stone 32*b* is inserted into the groove 24 of the end stone 22*b***.

On the inside the transition stones **32*a*, 32*b* have, by way of a modification of the stones 22, no corresponding radial grooves; instead, the stones are each formed with a substantially radial, projecting step 34**.

After installation of the transition stones **32*a*, 32*b*, a defined space exists between the two, which is then filled with a two-part keystone 36*a*, 36*b*. The keystones 36*a*, 36*b* are, like the transition stones 32*a*, 32*b*, structurally identical and are oriented in opposite directions. They have on their outer faces a recess 38 corresponding to the step 34 and are plane on their inner faces 40. First of all, therefore, the keystones 36*a*, 36*b* are placed in contact with one another with their faces 40, and are then inserted along the steps 34 axially into the transition region 30 with their projecting sections 42, until they close in a flush manner with the other stones 22, 32*a*, 32*b*** both on the front and rear sides. The arch-like support structure is then closed. Due to the arch arrangement and the formation of the individual stones with a substantially conical cross-section (viewed in the radial direction), the support structure is self-supporting.

Obviously, according to the particular use, the keystones **36*a*, 36*b* can be cut or ground by the amount appropriate to the distance. This is carried out preferably by appropriate treatment of the faces 40**.

Due to the arrangement of radially extending grooves/tongues 24, 28 between the stones 22, an excellent alignment of the individual stones with one another is achieved and an arrangement is achieved which withstands in particular lateral pressure from the lime body.

Then the second row of stones 16 is bonded, optionally in a similar manner to that described above.

If individual stones are then damaged in the first row 14, directly above only from the stones 22, the whole support structure would have had to be dismantled, because the individual stones 22 can only be removed radially upwards, but this path is blocked by the second row of stones 16 located above. With the construction according to the invention, this disadvantage can be overcome. It is then easily possible to remove first the keystones **36*a*, 36*b* laterally (axially) and then to remove the transition stones 32*a*, 32*b* or the damaged stones 22** laterally (tangentially), to replace and then re-build the support structure in the manner described above. Thus time, material and costs are saved.

We claim:

1. Keystone set for installation in the transition region (30) between two sections **(14*a*, 14*b*) of a support structure (14)**, which is formed as an arch and is comprised of fire-resistant stones (22), each of which has a trapezoid cross-section viewed from the side and is joined on its face corresponding to adjacent stones (22) via substantially radial tongue-and-groove arrangements (24, 28), the keystone set comprising two transition stones (32*a*, 32*b*), which on their outer sides, adjacent to the respective last stone (22*a*, 22*b*) of the corresponding section (14*a*, 14*b*) of the support structure (14), have a corresponding radially extending tongue of groove profile for positive locking and are formed on their opposite faces with a substantially axial step (34), the keystone set also comprising at least one keystone (36*a*, 36*b*), whose shape is such that it is axially insertable with positive locking into the space between the transition stones (32*a*, 32*b*), said keystone having first connection means for permitting axial insertion of the keystone into the space between the transition stones.

2. Keystone set according to claim 1, in which the keystone (36*a*, 36*b*) is divided.

3. Keystone set according to claim 2, in which the keystone (36*a*, 36*b*) is divided into two structurally identical sections (36*a*, 36*b*) lying opposite one another in a symmetrical manner.

4. Keystone set according to claim 2, in which the contact faces (40) of the keystones (36*a*, 36*b*) are formed flat.

5. Keystone set according to claim 2, in which the keystones (36*a*, 36*b*) can be joined together with positive locking.

6. Keystone set according to claim 5, in which the keystones (36*a*, 36*b*) can be joined with a tongue-and-groove joint.

7. Keystone set according to claim 1, in which the keystone (36*a*, 36*b*) (seen in the radial direction from the outside inwards) is conically formed.

8. Keystone set according to claim 1, in which the transition stones (36*a*, 36*b*) are structurally identically formed.

9. Keystone set according to claim 1, in which the tongue-and-groove devices of the transition stones (viewed in the radial direction from the outside inwards) are tapered.

10. Keystone set according to claim 1, in which the tongue-and-groove devices of the transition stones (viewed in the radial direction from the outside inwards) have a step.

11. Arch-like support structure comprising fire-resistant stones (22) with a cross-section which tapers conically from the outside inwards, the stones (22) including second connection means for hindering lateral movement of the stones and for permitting radial movement of the stones, said second connecting means including radially extending tongue-and-groove devices (24, 28) formed on the stones for connecting the stones together, said stones extending from two opposite bearing points in the form of two sections (14*a*, 14*b*) running in opposite directions, with a keystone set (20) according to claim 1 located between the free end sections (22*a*, 22*b*) of the sections (14*a*, 14*b*).

12. Keystone set for installation in a transition region (30) between two sections (14*a*, 14*b*) of a support structure (14), which is formed as an arch and is comprised of fire-resistant stones (22), each of which has a trapezoid cross-section when viewed from the side and is joined on its face corresponding to adjacent stones (22) via substantially radial tongue-and-groove arrangements (24, 28), the keystone set comprising two transitional stones (32*a*, 32*b*), which on their outer side, adjacent the respective last stone (22*a*, 22*b*) of the corresponding section (14*a*, 14*b*) of the support structure (14), have a corresponding tongue or groove profile for positive locking and are formed on their opposite faces with a substantially axial step (34), the keystone set also comprising at least one keystone (36*a*, 36*b*), whose shape is such that it is axially insertable with positive locking into the space between the transition stone (32*a*, 32*b*), the keystone (36*a*, 36*b*) being divided into two structurally identical sections (36*a*, 36*b*) lying opposite one another in a symmetrical manner, the contact faces (40) of the keystone sections (36*a*, 36*b*) being flat, further including positive locking means for joining the keystone sections (36*a*, 36*b*) together, said locking means including tongue-and-groove joints formed in the keystone sections (36*a*, 36*b*), the keystone sections (36*a*, 36*b*) (seen in the radial direction from the outside inward) being conically formed, the transition stones (36*a*, 36*b*) being structurally identically formed, the tongue-and-groove devices of the transition stones (viewed in the radial direction from the outside inward) being tapered, and the tongue-and-groove devices of the transition stones (view in the radial direction from the outside inward) having a step.

13. Arch-like support structure comprising fire-resistant stones (22) with a cross-section which tapers conically from the outside inward, the stones (22) being connected together by radial tongue-and-groove devices (24, 28) and extending from two opposite bearing points in the form of two sections (14*a*, 14*b*) running in opposite directions, with a keystone set (20) according to claim 12 located between the free end sections (22*a*, 22*b*) of the sections (14*a*, 14*b*).

* * * * *